US009826833B2

(12) United States Patent
Chen

(10) Patent No.: US 9,826,833 B2
(45) Date of Patent: Nov. 28, 2017

(54) RACK ASSEMBLY AND SUB-RACK THEREOF

(71) Applicant: I JANG INDUSTRIAL CO., LTD., Pitou Township, Changhua County (TW)

(72) Inventor: Hsin-Yueh Chen, Pitou Township (TW)

(73) Assignee: IJANG INDUSTRIAL CO., LTD., Pitou Township, Changhua County (TW)

( * ) Notice: Subject to any disclaimer, the term of this patent is extended or adjusted under 35 U.S.C. 154(b) by 95 days.

(21) Appl. No.: 14/953,116

(22) Filed: Nov. 27, 2015

(65) Prior Publication Data

US 2017/0150814 A1 Jun. 1, 2017

(51) Int. Cl.

| | |
|---|---|
| ***A47B 87/00*** | (2006.01) |
| ***A47B 55/02*** | (2006.01) |
| ***A47F 5/13*** | (2006.01) |

(52) U.S. Cl.

CPC ..... *A47B 87/008* (2013.01); *A47B 55/02* (2013.01); *A47F 5/137* (2013.01)

(58) Field of Classification Search

CPC ..... A47B 55/02; A47B 53/00; A47B 53/02; A47B 87/008; A47F 5/0093; A47F 5/10; A47F 5/137; A47F 3/06; A47F 3/004; B65G 1/10

USPC ..... 211/162; 312/198, 201

See application file for complete search history.

(56) References Cited

U.S. PATENT DOCUMENTS

| | | | | | |
|---|---|---|---|---|---|
| 447,658 | A * | 3/1891 | Brookman | A47F 3/063 | 211/162 |
| 1,807,075 | A * | 5/1931 | Skar | A47B 53/02 | 104/121 |
| 3,658,186 | A * | 4/1972 | Lodige | A47B 91/00 | 108/60 |
| 3,801,176 | A * | 4/1974 | Higbee | A47B 53/02 | 104/258 |
| 3,973,504 | A * | 8/1976 | Knudsen | B61B 10/02 | 104/172.4 |

(Continued)

FOREIGN PATENT DOCUMENTS

| | | |
|---|---|---|
| JP | 5-68922 | 9/1993 |
| JP | 11-18849 | 1/1999 |

OTHER PUBLICATIONS

English Abstract for JP11-018849, Total of 1 page.
English Abstract for JP5-68922, Total of 1 page.

*Primary Examiner* — Patrick Hawn
(74) *Attorney, Agent, or Firm* — Tracy M. Heims; Apex Juris pllc.

(57) ABSTRACT

A rack assembly having two side racks, two rails, and at least one sub-rack, wherein the rails are mounted between the side racks and include a front rail and a rear rail lower than the front rail. Each rail has an opening in a side of the rail, with the opening of the front rail defined in a bottom of the front rail and the opening of the rear rail defined in the rear rail at a side facing the front rail. The at least one sub-rack has a rack frame, a connection rod, and at least one supporting member and is slidable along the rails The rack frame has at least one front rod and at least one rear rod wherein each front rod has an extension rod mounted retractably on a top of the front rod and a front wheel.

8 Claims, 9 Drawing Sheets

(56) References Cited

U.S. PATENT DOCUMENTS 4,153,312 A * 5/1979 Taniwaki ..... A47B 53/02 105/86
4,615,449 A * 10/1986 Naito ..... A47B 53/02 211/162
4,840,000 A * 6/1989 Grines ..... A45D 44/02 297/344.1
4,955,489 A * 9/1990 Allen ..... B65G 1/026 211/151
4,991,725 A * 2/1991 Welsch ..... A47B 53/02 211/162
5,072,838 A * 12/1991 Price, Jr. ..... A47B 53/00 211/122
5,226,549 A * 7/1993 Price, Jr. ..... A47B 53/00 211/162
5,584,546 A * 12/1996 Gurin ..... A47B 21/00 16/19
5,680,942 A * 10/1997 McAllister ..... A47F 5/0093 16/35 R
6,241,106 B1 * 6/2001 Fujita ..... A47B 53/02 211/134
6,471,309 B1 * 10/2002 Turner ..... A47B 53/02 211/162
6,688,708 B1 * 2/2004 Janson ..... A47B 53/02 312/200
7,124,902 B1 * 10/2006 Chen ..... A47B 53/02 211/151
7,413,091 B2 * 8/2008 Krull ..... A47F 7/04 211/162
7,469,793 B2 * 12/2008 Chen ..... A47B 53/02 211/162
8,020,714 B2 * 9/2011 Miller, Jr. ..... A47F 3/0404 108/107
8,371,666 B2 * 2/2013 Wu ..... H05K 7/1497 312/334.24
8,567,883 B2 * 10/2013 Hsiao ..... H05K 7/1489 312/201
8,789,899 B2 * 7/2014 Pirro ..... A47F 3/004 312/202
2002/0162813 A1 * 11/2002 Hall ..... A47F 5/137 211/133.1
2003/0094884 A1 * 5/2003 Sobol ..... A47B 53/00 312/201
2004/0178155 A1 * 9/2004 Brownfield ..... A47F 7/08 211/36
2004/0256339 A1 * 12/2004 Welsch ..... A47B 53/02 211/162
2007/0108147 A1 * 5/2007 Chen ..... A47B 47/00 211/187
2007/0144992 A1 * 6/2007 Chen ..... A47B 53/02 211/162
2008/0006593 A1 * 1/2008 Tenreiro ..... H05K 7/18 211/162
2008/0190876 A1 * 8/2008 Janson ..... E05D 15/0652 211/162
2009/0021122 A1 * 1/2009 Green ..... A47B 47/0091 312/107
2011/0094978 A1 * 4/2011 Bailey ..... H05K 7/1495 211/26.2
2012/0104918 A1 * 5/2012 Peng ..... H05K 7/1497 312/334.27

* cited by examiner

RACK ASSEMBLY AND SUB-RACK THEREOF

BACKGROUND OF THE INVENTION

1. Field of the Invention

The present invention relates to a rack assembly, and more particularly to a rack assembly having at least one sub-rack that is detachable from the rack assembly.

2. Description of Related Art

To display goods to customers in a store or a hypermarket, rack assemblies are applied. A conventional rack assembly substantially comprises a rack frame composed of multiple rods and multiple supporting members mounted securely on the rack frame. Accordingly, the goods can be put on and supported by the supporting members for customer to purchase.

However, the supporting members are securely mounted on the rack frame, so the supporting members cannot be detached from the rack frame or the positions of the supporting members cannot be adjusted relative to the rack frame. Therefore, the use of the conventional rack assembly is limited and is not versatile.

To overcome the shortcomings, the present invention tends to provide a rack assembly to mitigate or obviate the aforementioned problems.

SUMMARY OF THE INVENTION

The main objective of the invention is to provide a rack assembly having sub-rack(s) being adjustable in amount and position.

The rack assembly has two side racks, two rails, and at least one sub-rack. The side racks are spaced from each other. The rails are mounted between and connected with the side racks, are parallel with each other, and include a front rail and a rear rail located at a height lower than that of the front rail to form a height difference between the front rail and the rear rail. Each rail has a U-section to form an opening in a side of the rail. The opening of the front rail is defined in a bottom of the front rail and faces downward. The opening of the rear rail is defined in the rear rail at a side facing the front rail. The at least one sub-rack is disposed between the side racks and is slidable along the rails. Each one of the at least one sub-rack has a rack frame, a connection rod, and at least one supporting member. The rack frame is composed of multiple longitudinal rods including at least one front rod and at least one rear rod corresponding in position respectively to the front rail and the rear rail. Each one of the at least one rear rod has a rear wheel mounted rotatably on a top of the rear rod and held slidably in the rear rail. Each one of the at least one front rod has an extension rod mounted retractably on a top of the front rod and having a top and a front wheel mounted rotatably on the top of the extension rod. The connection rod is connected to the extension rod of each one of the at least one front rod. The at least one supporting member is mounted on the rack frame.

Other objects, advantages and novel features of the invention will become more apparent from the following detailed description when taken in conjunction with the accompanying drawings.

DETAILED DESCRIPTION OF PREFERRED EMBODIMENT

Figure 1:
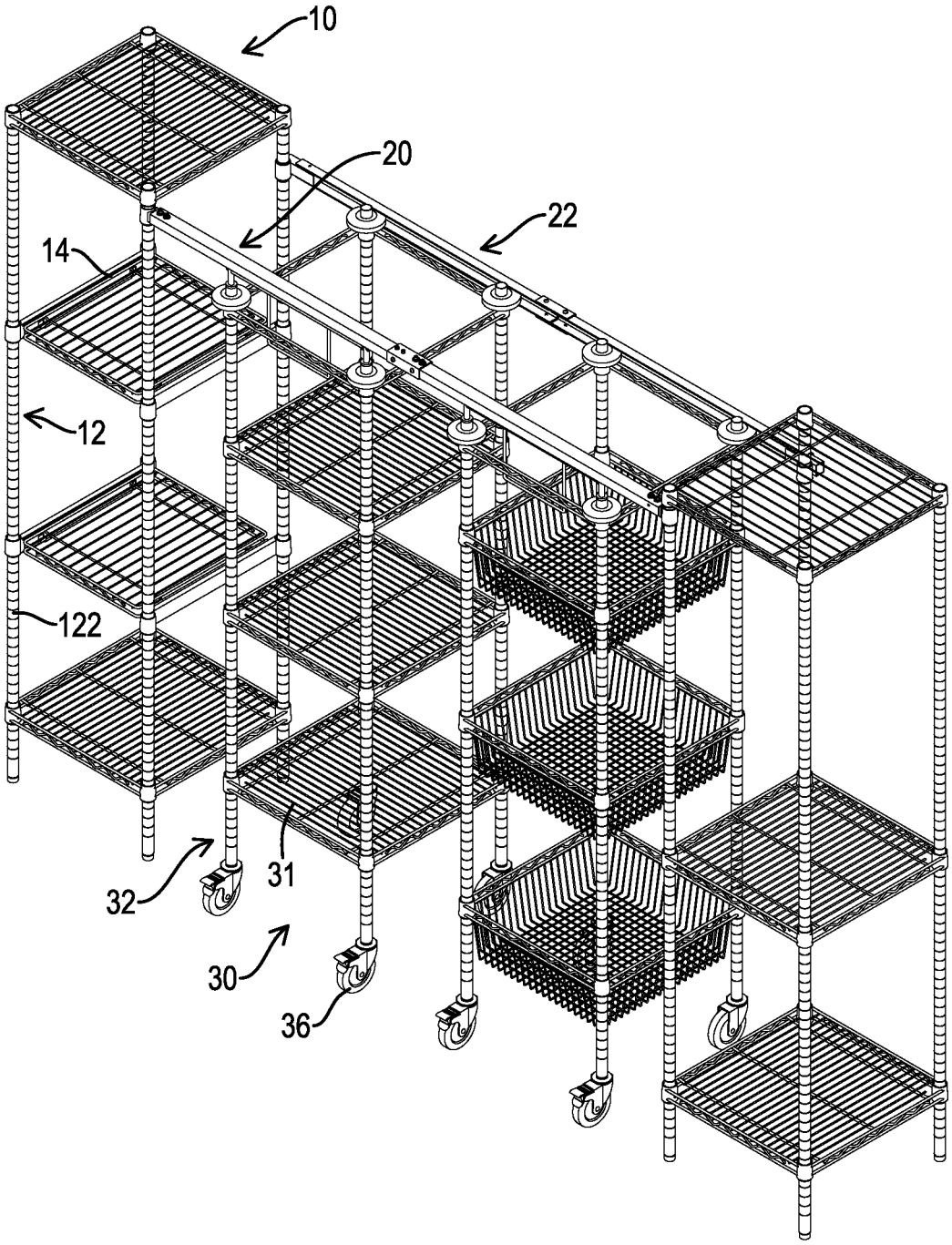
FIG. 1 is a perspective view of a rack assembly in accordance with the present invention.
Figure 8:
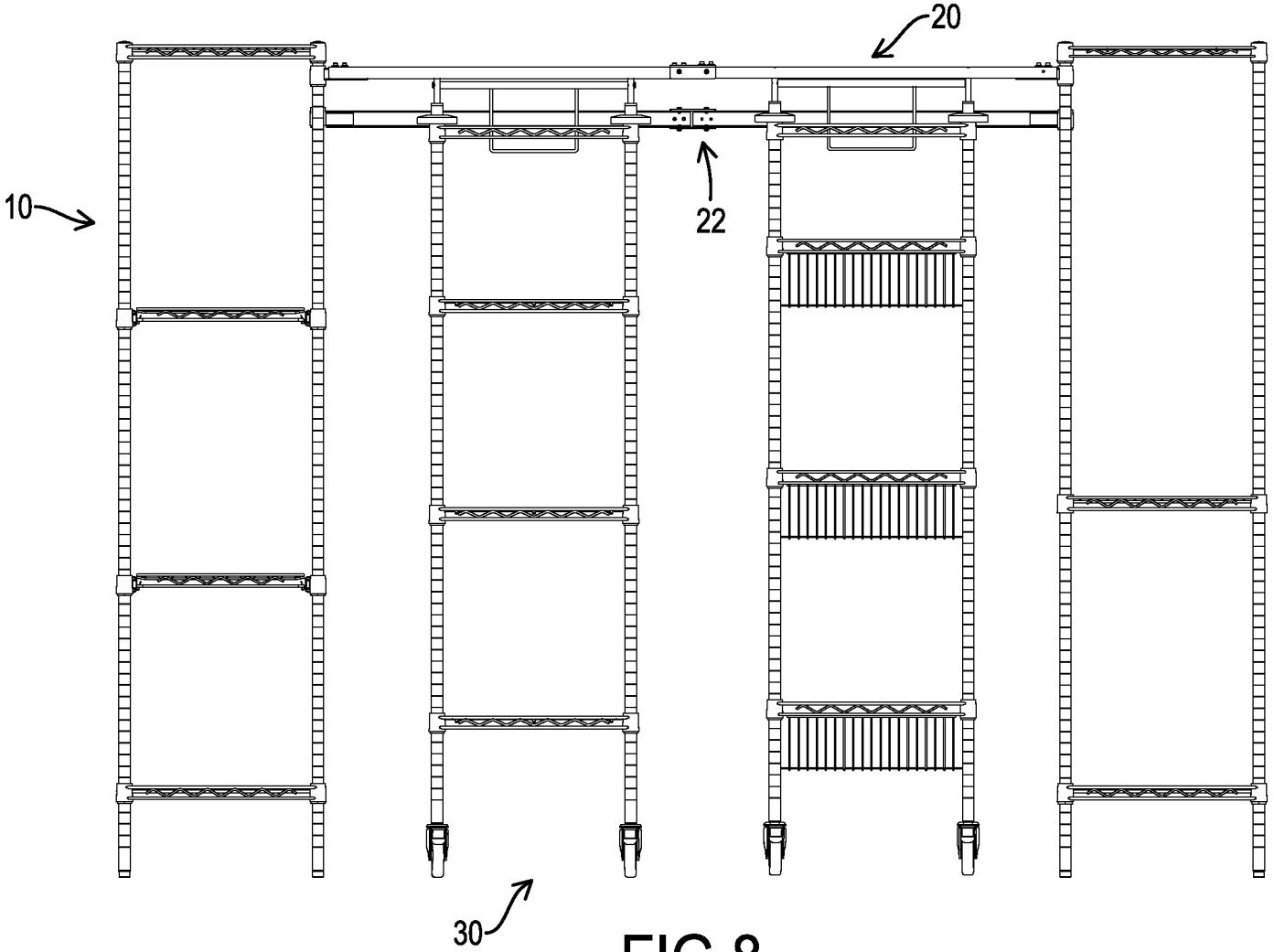
FIG. 8 is a front view of the rack assembly in FIG. 1.

With reference to FIGS. 1 and 8, a rack assembly in accordance with the present invention comprises two side racks 10, two rails 20,22 and at least one sub-rack 30. The side racks 10 are spaced from each other. Each side rack 10 comprises a rack frame 12 composed of multiple longitudinal rods 122 and at least one supporting member 14 mounted securely on the rack frame 12. Each supporting member 14 may be a plate or a bracket to support objects on the supporting member 14. The rails 20,22 are mounted between and connected with the side racks 10, are parallel with each other, and include a front rail 20 and a rear rail 22. The rear rail 22 is located at a height lower than that of the front rail 20 to form a height difference between the front rail 20 and the rear rail 22. Each rail 20,22 has a U-section to form an opening 202,222 in a side of the rail 20,22. The opening 202 of the front rail 20 is defined in a bottom of the front rail 20 and faces downward. The opening 222 of the rear rail 22 is defined in the rear rail 22 at a side facing the front rail 20.

Figure 2:
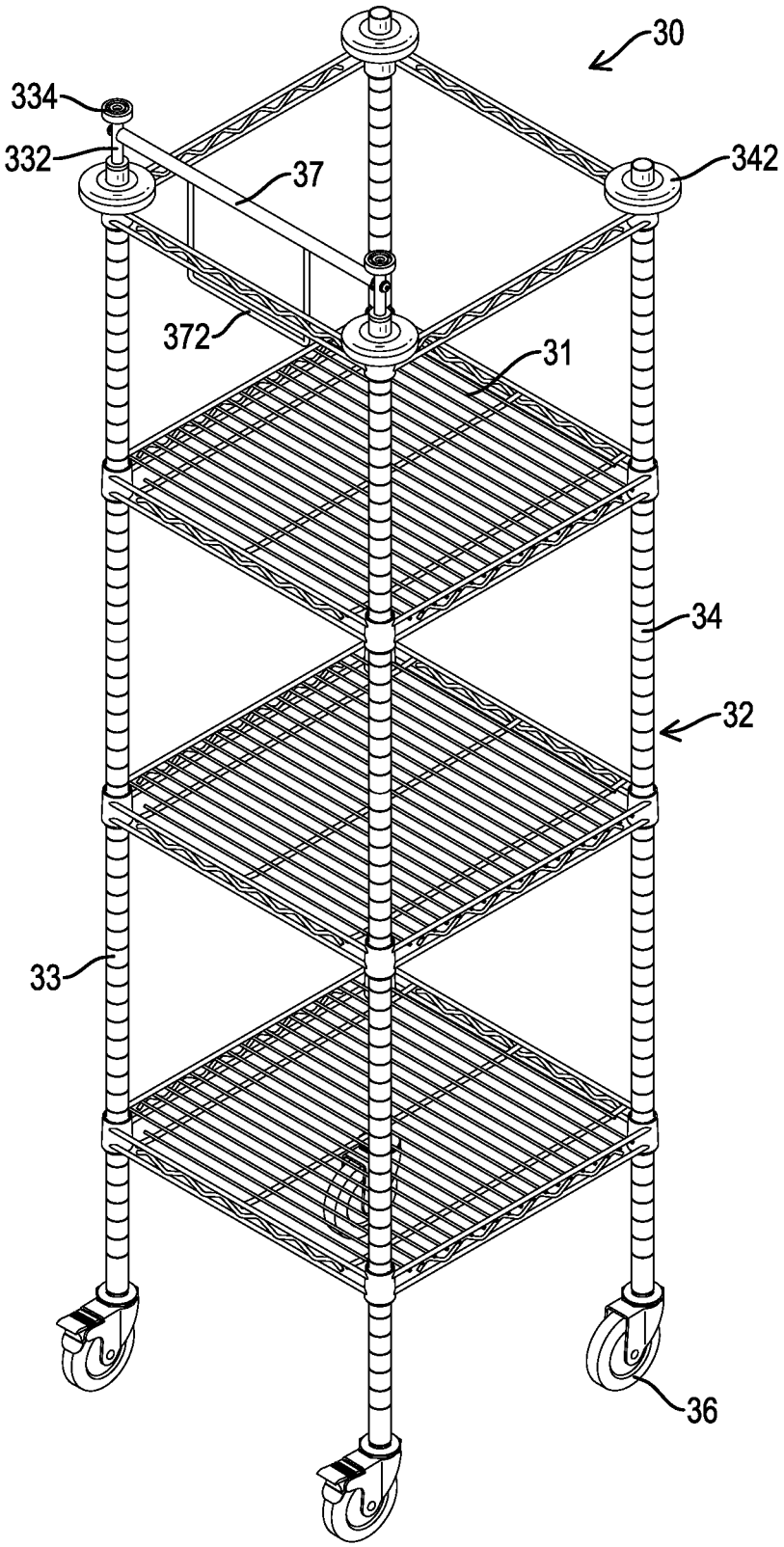
FIG. 2 is a perspective view of a sub-rack assembly in accordance with the present invention.
Figure 3:
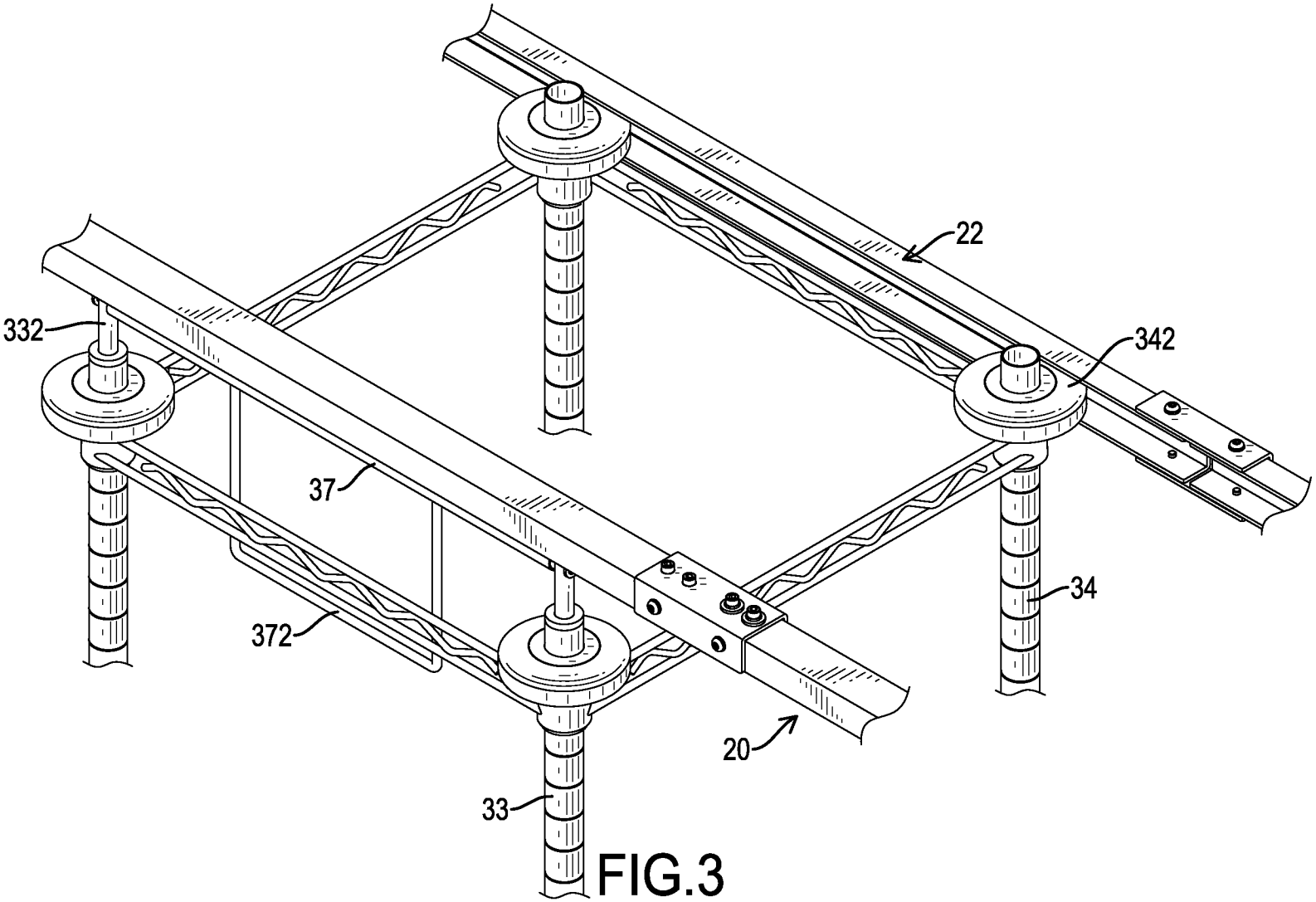
FIG. 3 is an enlarged perspective view of the rack assembly in FIG. 1.
Figure 4:
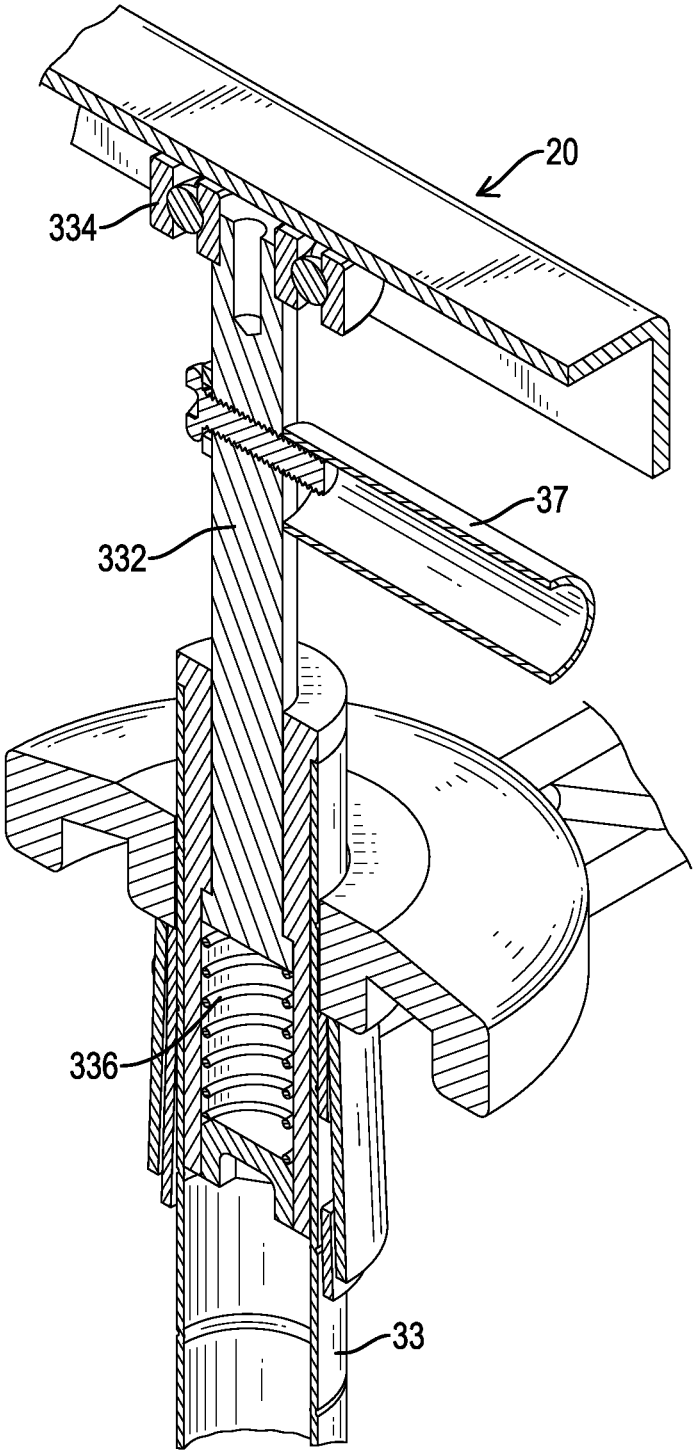
FIG. 4 is an enlarged cross sectional perspective view of the rack assembly in FIG. 1.
Figure 5:
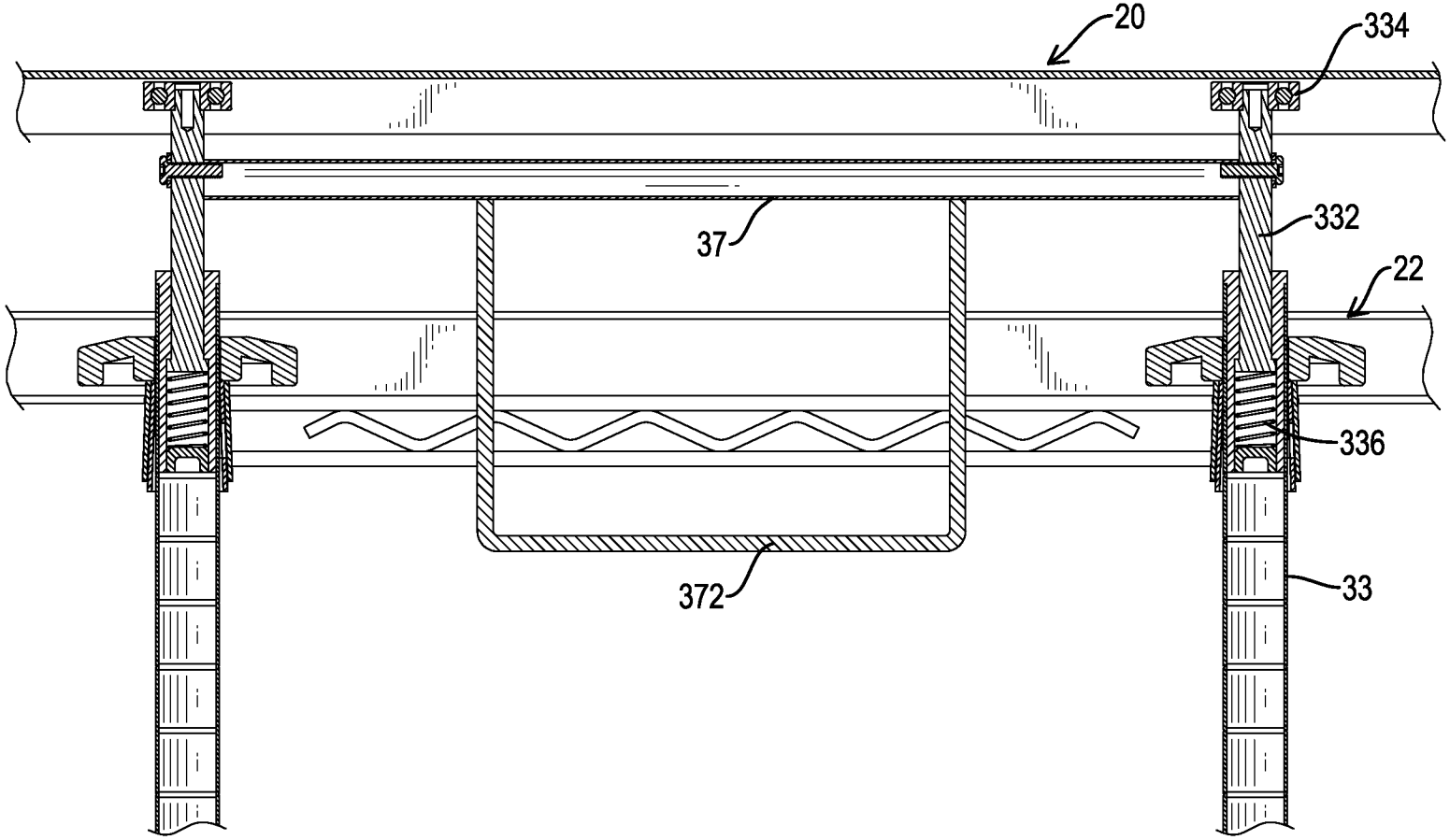
FIG. 5 is an enlarged front view in partial section of the rack assembly in FIG. 1.

With reference to FIGS. 2, 3, and 5, the at least one sub-rack 30 is disposed between the side racks 10 and is slidable along the rails 20,22. In the embodiment as shown in FIG. 1, two sub-racks 30 are implemented. Each sub-rack 30 comprises a rack frame 32, a connection rod 37, and at least one supporting member 31. The rack frame 32 is composed of multiple longitudinal rods 33, 34. The rods 33, 34 include at least one front rod 33 and at least one rear rod 34 corresponding in position respectively to the front rail 20 and the rear rail 22. Preferably, two front rods 33 and two rear rods 34 are implemented. Each rear rod 34 has a rear wheel 342 mounted rotatably on a top of the rear rod 34 and held slidably in the rear rail 22. Each front rod 33 has an extension rod 332 mounted retractably on a top of the front rod 33 and having a top and a front wheel 334 mounted rotatably on the top of the extension rod 332. In addition, each front rod 33 has a spring 336 mounted in the front rod 33 and abutting a bottom of the extension rod 332 to push the extension rod 332 upward and to hold the front wheel 334 in the front rail 20. Furthermore, each rod 33, 34 has a bottom and a rotating wheel 36 mounted on the bottom of the rod 33, 34.

The connection rod 37 is connected to the extension rods 332 of the front rods 33. In addition, each sub-rack 30 further comprises a pulling rod 372 mounted on the connection rod 37 of the sub-rack 30. Accordingly, the connection rod 37 can be pulled downward by pulling the pulling rod 372, and the extension rods 332 can be retracted into the front rods 33 and the front wheels 334 will escape from the front rail 20 via the opening 202 in the front rail 20.

The at least one supporting member 31 is mounted securely on the rack frame 32. Each supporting member 31 may be a plate or a bracket to support objects on the supporting member 31.

Figure 9:
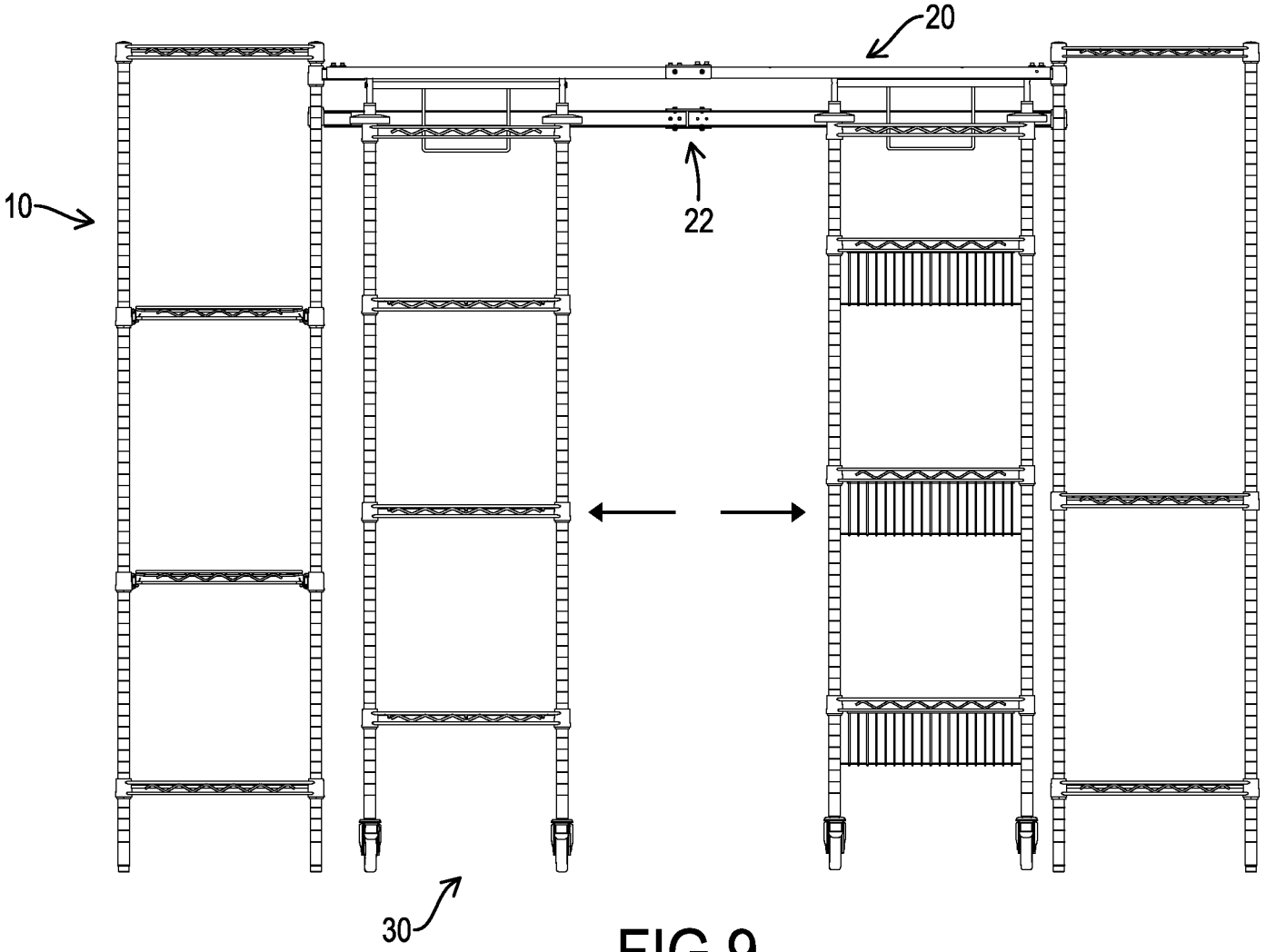
FIG. 9 is an operational front view of the rack assembly in FIG. 1.

With reference to FIGS. 1, 8, and 9, because the sub-racks 30 are slidable along the rails 20,22, the positions of the sub-racks 30 can be adjusted by moving the sub-racks 30 along the rails 20,22 to fit with different use demands. Accordingly, the rack assembly is versatile in use.

Figure 6:
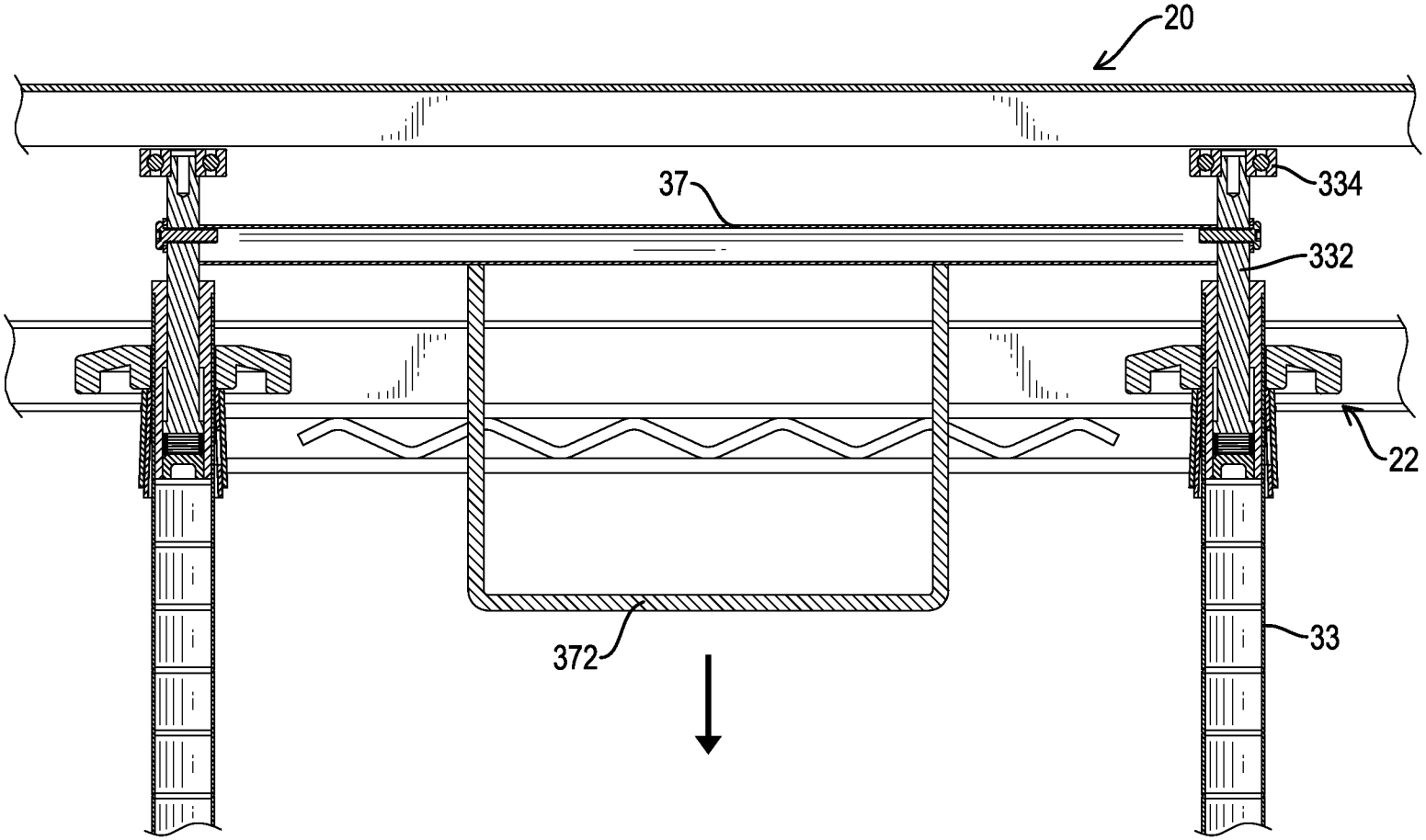
FIG. 6 is an enlarged operational front view in partial section of the rack assembly in FIG. 1.
Figure 7:
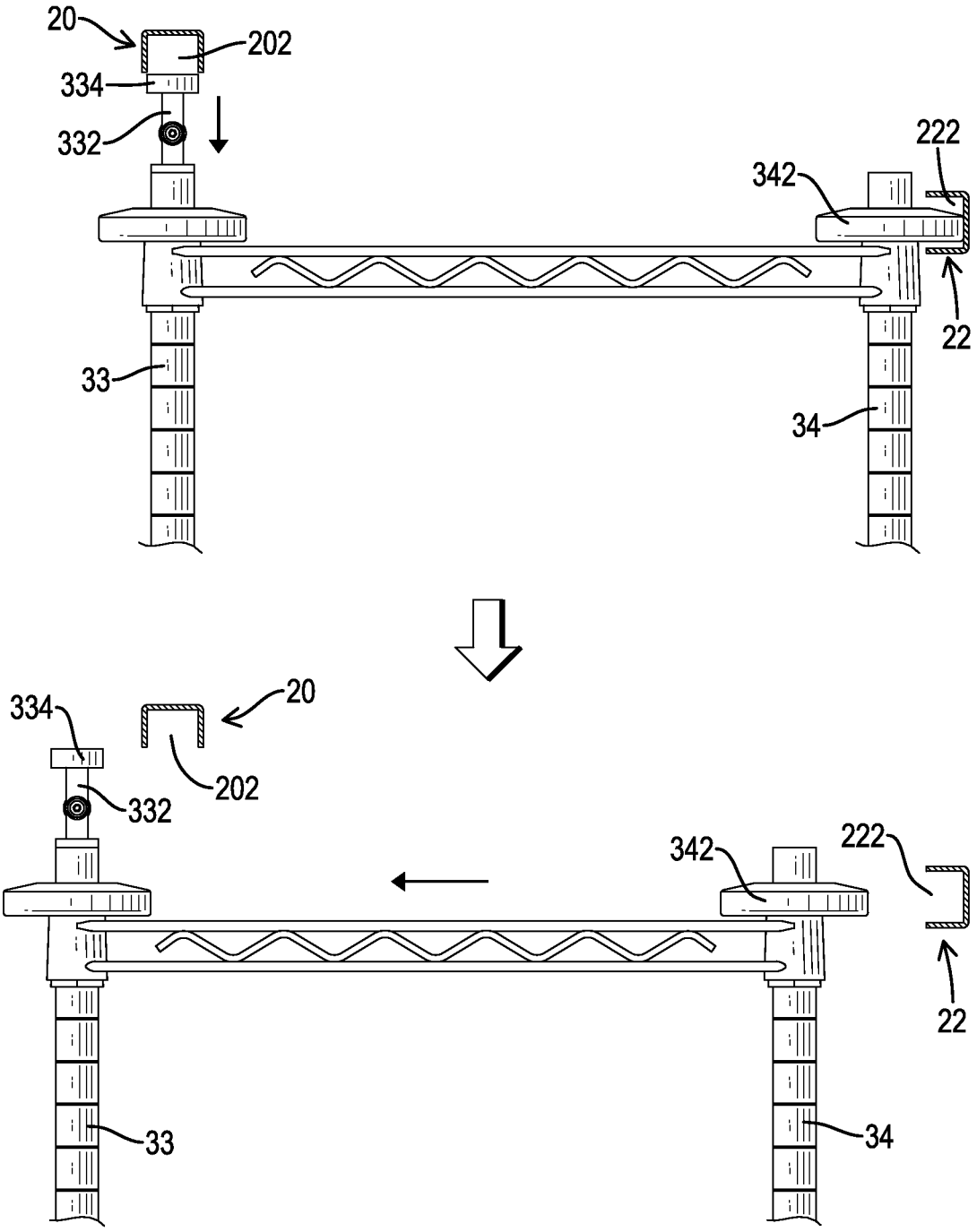
FIG. 7 shows enlarged operational side views in partial section of the rack assembly in FIG. 1.

With reference to FIGS. 1, 6, and 7, when the connection rod 37 or the pulling rod 372 of one of the sub-racks 30 is pulled downward, the extension rods 332 of the sub-rack 30 will be retracted into the front rods 33 and the front wheels 334 will escape from the front rail 20 via the opening 202 of the front rail 20. Because the opening 222 in the rear rail 22 faces to the front rail 20 and the rear rail 22 is lower than the front rail 20, the sub-rack 30 can be pushed to move forward relative to the side racks 10 even to leave the position between the side racks 10. Consequently, the sub-rack 30 can be applied to support objects individually. Accordingly, the amounts and the positions of the sub-racks 30 between the side racks 10 can be changed to fit with different user demands, such that the rack assembly is versatile in use.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A rack assembly comprising:

two side racks spaced from each other;

two rails mounted between and connected with the side racks, being parallel with each other, and including a front rail and a rear rail, the rear rail located at a height lower than a height of the front rail to form a height difference between the front rail and the rear rail, and each rail having a U-section to form an opening in a side of the rail, wherein the opening of the front rail is defined in a bottom of the front rail and faces downward; and the opening of the rear rail is defined in the rear rail at a side facing the front rail;

at least one sub-rack disposed between the side racks, being slidable along the rails, and each one of the at least one sub-rack comprising a rack frame composed of multiple longitudinal rods, which include at least one front rod and at least one rear rod corresponding in position respectively to the front rail and the rear rail, wherein each one of the at least one rear rod has a rear wheel mounted rotatably on a top of the rear rod and held slidably in the rear rail; and each one of the at least one front rod has an extension rod mounted retractably on a top of the front rod and having a top and a front wheel mounted rotatably on the top of the extension rod;

a connection rod connected to the extension rod of each one of the at least one front rod; and at least one supporting member mounted on the rack frame.

2. The rack assembly as claimed in claim 1, wherein each side rack comprises a rack frame composed of multiple longitudinal rods and at least one supporting member mounted securely on the rack frame of the side rack.

3. The rack assembly as claimed in claim 2, wherein each one of the at least one sub-rack further comprises a pulling rod mounted on the connection rod of the sub-rack.

4. The rack assembly as claimed in claim 3, wherein each rod of each one of the at least one sub-rack has a bottom and a rotating wheel mounted on the bottom of the rod of the sub-rack.

5. The rack assembly as claimed in claim 1, wherein each one of the at least one sub-rack further comprises a pulling rod mounted on the connection rod of the sub-rack.

6. The rack assembly as claimed in claim 5, wherein each rod of each one of the at least one sub-rack has a bottom and a rotating wheel mounted on the bottom of the rod of the sub-rack.

7. The rack assembly as claimed in claim 2, wherein each rod of each one of the at least one sub-rack has a bottom and a rotating wheel mounted on the bottom of the rod of the sub-rack.

8. The rack assembly as claimed in claim 1, wherein each rod of each one of the at least one sub-rack has a bottom and a rotating wheel mounted on the bottom of the rod of the sub-rack.

* * * * *